United States Patent [19]

Uthoff, Jr. et al.

[11] Patent Number: 4,759,326

[45] Date of Patent: Jul. 26, 1988

[54] METHOD OF CONTROLLING ENGINE IDLE SPEED AND AIR THROTTLE THEREFOR

[75] Inventors: Loren H. Uthoff, Jr., Canton; Walter Wilson, Westland, both of Mich.

[73] Assignee: Eaton Corporation, Cleveland, Ohio

[21] Appl. No.: 884,140

[22] Filed: Jul. 10, 1986

[51] Int. Cl.[4] ..... F02M 3/00

[52] U.S. Cl. ..... 123/339; 123/337

[58] Field of Search ..... 123/337, 339, 585, 586; 261/65; 137/630.15

[56] References Cited

U.S. PATENT DOCUMENTS 1,130,103 3/1915 Plumm ..... 123/337

4,158,352 6/1979 Blatter ..... 123/337 X 4,408,581 10/1983 Pfalzgraf et al. ..... 123/339

4,438,745 3/1984 Watanabe ..... 123/339

*Primary Examiner*—Willis R. Wolfe, Jr.

*Attorney, Agent, or Firm*—D. A. Rowe; J. A. Johnston

[57] ABSTRACT

An air throttle for an internal combustion engine having a shaft mounted butterfly vane mounted for rotation in the engine charge air inlet. The butterfly vane and shaft have an idle air bleed slot therethrough with a tubular idle valve mounted over said shaft for concentric rotation thereabout. With the butterfly vane closed for idle mode running, the idle valve is rotated between set limits to control idle air flow and idle speed. Upon rotation of the idle valve beyond the set limits, the butterfly is progressively opened for off-idle mode running speed control.

1 Claim, 1 Drawing Sheet

Fig. b

METHOD OF CONTROLLING ENGINE IDLE SPEED AND AIR THROTTLE THEREFOR

CROSS-REFERENCE TO RELATED APPLICATION

The present application is related to application Ser. No. 884,134, filed Oct. 17, 1986 concurrently herewith in the name of Stephen E. Kain, entitled Nested Butterfly Throttle and commonly assigned to the assignee of the present invention.

BACKGROUND OF THE INVENTION

The present invention relates to air throttling for the charge air inlet of an internal combustion engine, where it is common practice to provide a butterfly-type vane rotatably disposed in the throttling passage of the engine charge air inlet. Butterfly-vane type air throttles provide responsive and effective valving of the engine charge air for off-idle engine operation requiring part or fully opened throttle. However, in idle operation requiring substantially closed throttle, the butterfly-vane type air throttle has the disadvantage that an extremely small movement of the throttle vane produces drastic changes in engine speed. Consequently, it has been the practice in engine design to provide only fixed speed engine idle control by adjustment of a limit stop for maintaining the butterfly-vane throttle "cracked" or opened only a very small amount from the fully closed position during engine idle conditions.

However, in order to provide adequate charge air to the engine inlet when idle speed load conditions change, the butterfly throttle vane, must be moved to vary the flow of charge air to the engine inlet. For example, when the vehicle air conditioner is cycled at idle, the substantial change in engine load requires a compensating throttle change. However, it has been found difficult to provide a vehicle operator adjustable idle speed control. Presently, it is the practice to provide a solenoid operated step for the fixed adjustment for closed throttle limit stop. The solenoid, when actuated, positions a "fast idle" cam under the closed throttle position adjustment screw ior holding the throttle open a slight additional amount to increase engine idle speed.

It has, however, been desired to provide a way or means of varying the engine change air flow in order to maintain a constant idle speed either by vehicle operator control or by automatic electric control. In particular, where engine fuel injection is controlled electrically by a microprocessor on board the vehicle, in order to control combustion to minimize engine emissions, it has been desired to provide a way or means of electrically varying the engine idle speed to provide the most efficient combustion at idle and also to accommodate changes in accessory load on the engine while running in idle mode.

SUMMARY OF THE INVENTION

The present invention provides precision controllable air throttling of an engine for control of the running speed at engine idle mode of operation. The present invention employs a butterfly vane type primary throttling valve mounted on a shaft disposed for rotation about an axis transverse to the direction of air flow in the engine inlet. An idle bleed flow slot is provided through the vane and shaft for permitting charge air flow therethrough, when the butterfly vane is in the closed position. An idle speed throttling valve is provided in the form of a tubular member disposed concentrically about the butterfly vane shaft; and, the tubular member is rotatable with respect to the butterfly vane and shaft for valving the idle bleed slot for engine speed control in the idle mode with the butterfly vane closed.

As the tubular idle valve rotates to the position fully opening the idle bleed slot, contact surfaces on the tubular idle valve register against a pin provided through the butterfly vane shaft and cause the butterfly vane to open upon further rotation of the tubular idle valve. The present invention thus provides idle speed control of the engine by controlling a flow of air through an idle flow passage in the main throttle valve, with a rotatable idle flow valve moved by the same actuator employed for movement of the primary throttle.

BRIEF DESCRIPTION OF THE DRAWINGS

FIG. 2*b* is similar to FIG. 2*a*, and shows the idle valve in the closed position.

DETAILED DESCRIPTION

Figure 1:
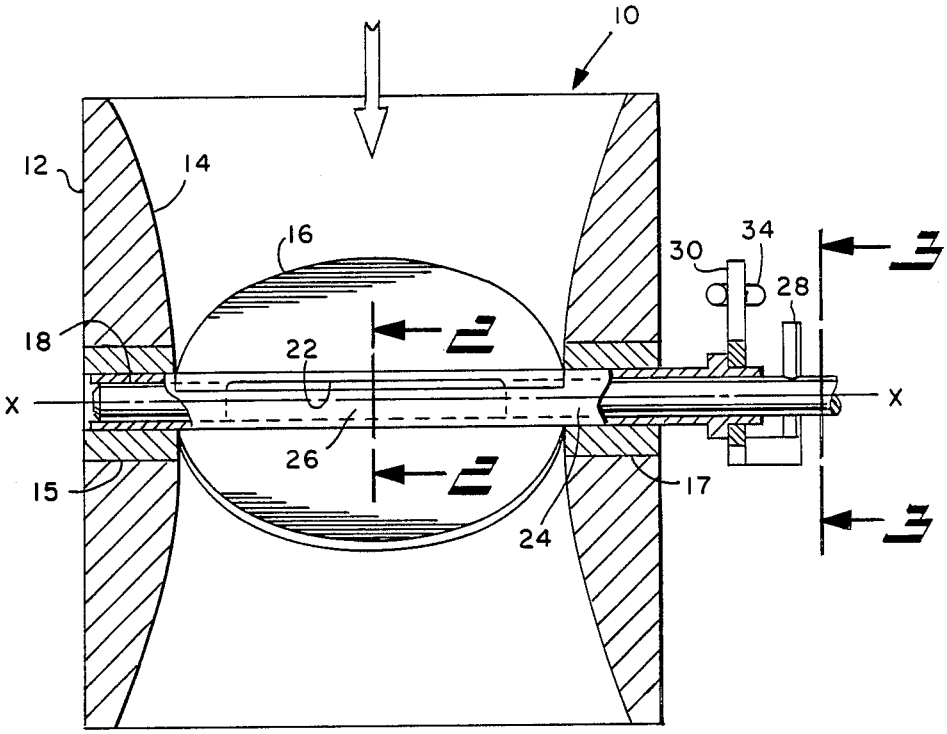
FIG. 1 is a longitudinal section through the charge air inlet passage of an engine throttle body.

Referring now to FIG. 1, the throttle of the present invention is indicated generally at 10, and has a throttle body 12 with a venturi passage 14 formed therethrough for flow of engine charge air therethrough to the engine inlet in the direction indicated by the double arrow. Although passage 14 is shown as a venturi, a straight-walled passage may be employed if desired. A suitable butterfly vane 16 is disposed in the passage 14 and is shown in the closed position in FIG. 1.

The butterfly 16 is rotatable about the axis X—X , which extends through the venturi throat in a direction transverse to the flow. The butterfly vane 16 is attached to a shaft 18, which is journalled for rotation in the throttle body as will hereinafter be described.

In the presently preferred practice, the vane is received through a slot, denoted by the reference numeral 20 formed through the shaft 18; and, the vane 16 is retained therein by any suitable fastening expedient, such as screws or staking.

Figure 2A:
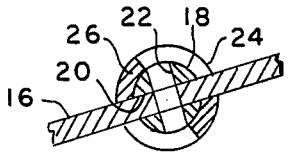
FIG. 2*a* is a section view taken along section-indicating lines 2—2 of FIG. 1.

Referring to FIGS. 1, 2*a* and 2*b*, the shaft 18 and vane 16 have an idle bleed flow slot 22 provided therethrough which permits flow of charge inlet air through the venturi when the butterfly vane 16 is in the closed position in the passage 14. A tubular idle valve member 24 is received over the shaft 14 for concentric rotation with respect thereto. The shaft 24 is journalled at its ends in bearings 15, 17 provided in the throttle body for rotation therein.

Referring now to FIG. 1 and FIG. 2*a*, shaft 24 has an arcuately shaped valving portion 26 which is shown in FIG. 2*a* rotated to a position fully opening the idle bleed slot 22.

Referring to FIG. 1 and FIG. 2*b*, the tubular member 24 is rotated clockwise from the position shown in FIG. 2*a* to a position wherein valving portion 26 closes the idle bleed slot 22, as shown in FIG. 2*b*.

Figure 3:
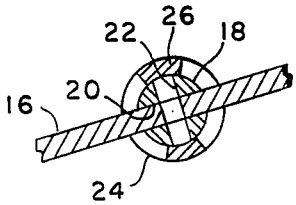
FIG. 3 is a view taken along section indicating lines 3—3 of FIG. 1.
Figure 3:
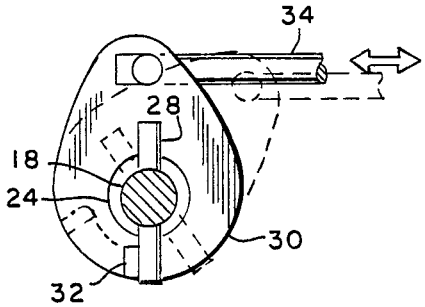

Referring to FIGS. 1 and 3, the shaft 18 extends outwardly from the throttle body bearing 17 at one end thereof, and has a cross pin 28 provided therethrough. The tubular valving member 24 also extends outwardly at one end from the throttle body, as shown in FIG. 1. The shaft 18 however, extends outwardly beyond the end of the tubular member 24. The valving member 24 has attached thereto for effecting rotation thereof, a crank member 30, which has a lug or tab 32 extending therefrom in the direction of the axis. Tab 32 contacts pin 28, as shown in FIG. 3, when the tubular valving member 24 is rotated to the position shown in FIG. 2*a*, fully opening the idle bleed slot 22. With continuing reference to FIG. 3, the crank 30 has a control actuator member 34 connected thereto through an aperture provided through the crank arm 30. The control actuator member 34 is reciprocated by a suitable power mechanism (not shown), in the direction indicated by the double arrow in FIG. 3.

The crank arm 30 is rotated to the position shown in dashed outline in FIG. 3, when the tubular idle valve member 24 is rotated to the position shown in FIG. 2*b*. It will be understood, with reference to FIGS. 2*a* and 3, that if the tubular idle valve member 24 is rotated by crank arm 30 in a counterclockwise direction beyond, or further than the position shown in FIG. 2*a*, that the butterfly valve 16 is opened. This is caused by the tab 32 rotating the crosspin to the position shown in dashed outline in FIG. 3. Thus, the present invention enables an automatic actuating mechanism, such as an electric servomotor (not shown) to drive throttle actuating rod 34 to provide continuous engine speed control in the idle mode with the main throttle 16 closed; and, upon movement of the idle valve 24 beyond a position fully opening the idle bleed passage, the main throttle vane 16 is opened for off-idle engine speed control.

Although the invention has hereinabove been described with respect to the illustrated embodiment, it is understood that the invention is capable of modification and variation, and is limited only by the following claim.

We claim:

1. A throttle assembly for controlling the flow in a charge air inlet passage of an internal combustion engine comprising:

(a) a main valve comprising a valve mounted on a shaft disposed for rotation in said charge inlet passage about an axis transverse to the direction of charge air flow, said main valve member having an idle bleed shot formed therethrough, and operable upon rotation to move between an open and closed position in said charge air inlet passage;

(b) idle speed valve means including a sleeve member disposed over said main valve shaft for limited concentric rotation with respect thereto, said idle valve means operable, when said main valve is closed and upon rotation of said sleeve member between predetermined limits, to effect progressive opening and closing of said idle bleed shot for engine idle speed control;

(c) means attached to one of said main valve and said idle flow valve and defining a reaction surface operable upon rotation of said idle flow valve means beyond said predetermined limits to effect progressive opening and closing of said main valve for off-idle engine speed control.

* * * * *